US009101176B2

(12) United States Patent
Benton

(10) Patent No.: US 9,101,176 B2
(45) Date of Patent: Aug. 11, 2015

(54) SELF-CLOSING HELMET STRAP

(76) Inventor: Frances H. Benton, Keene, NH (US)

( * ) Notice: Subject to any disclaimer, the term of this patent is extended or adjusted under 35 U.S.C. 154(b) by 1130 days.

(21) Appl. No.: 13/100,336

(22) Filed: May 4, 2011

(65) Prior Publication Data

US 2012/0278976 A1 Nov. 8, 2012

(51) Int. Cl.

| | |
|---|---|
| ***A63B 71/10*** | (2006.01) |
| ***A42B 7/00*** | (2006.01) |
| ***A41F 3/04*** | (2006.01) |
| ***A44B 1/04*** | (2006.01) |
| ***A42B 3/08*** | (2006.01) |
| ***A42B 3/00*** | (2006.01) |
| *A42B 3/14* | (2006.01) |

(52) U.S. Cl.
CPC ... *A42B 3/08* (2013.01); *A42B 3/00* (2013.01); *A42B 3/085* (2013.01); *A42B 3/14* (2013.01)

(58) Field of Classification Search
CPC ..... A42B 3/00; A42B 3/08; A42B 3/085; A42B 3/14; A42B 3/147
USPC ..... 2/420, 421, 425; 24/593.11
See application file for complete search history.

(56) References Cited

U.S. PATENT DOCUMENTS

| | | | | |
|---|---|---|---|---|
| 1,003,907 | A * | 9/1911 | Hoffman | 24/21 |
| 1,073,714 | A * | 9/1913 | Shorten | 24/593.11 |
| 1,187,571 | A * | 6/1916 | Vanmeer | 24/593.11 |
| 3,900,923 | A * | 8/1975 | Thomas | 24/16 PB |
| 4,110,847 | A | 9/1978 | Dera | |
| 4,445,253 | A | 5/1984 | Howey | |
| 4,651,356 | A | 3/1987 | Zide | |
| 4,856,119 | A * | 8/1989 | Haberle | 2/417 |
| 5,608,918 | A | 3/1997 | Salvaggio | |
| 5,638,551 | A * | 6/1997 | Lallemand | 2/421 |
| 5,666,700 | A | 9/1997 | Anscher et al. | |
| 5,685,020 | A * | 11/1997 | Powell et al. | 2/421 |
| 5,704,072 | A | 1/1998 | Garneau | |
| 5,915,538 | A * | 6/1999 | Basson et al. | 2/421 |
| 6,003,156 | A | 12/1999 | Anderson | |
| 6,360,404 | B1 | 3/2002 | Mudge et al. | |
| 7,246,383 | B2 | 7/2007 | Musal | |
| 7,600,268 | B2 * | 10/2009 | Rogers et al. | 2/6.6 |
| 7,866,005 | B2 * | 1/2011 | Vermeer et al. | 24/16 PB |
| 2002/0023290 | A1 | 2/2002 | Watters et al. | |
| 2006/0179537 | A1 | 8/2006 | Dennis et al. | |
| 2010/0281603 | A1 * | 11/2010 | Ho | 2/411 |

OTHER PUBLICATIONS

Standard for Bicycle Helmets; Final Rule, 16 CFR Part 1203 Federal Register/vol. 63, No. 46/Tuesday, Mar. 10, 1998/Rules and Regulations, Consumer Product Safety Commission.
Jonothan Gornal "Cyclists Find Ways Around Safety Helmet Law", "The National", Dec. 4, 2010.
Rick Price, Ph.D "A vision for smart cycling education in Fort Collins", The Coloradoan, Nov. 18, 2010. With reference to a Strap 'n Snap bicycle helmet program for Fort Collins, Colorado.
Bicycle Safety Helmet Institute, "Playgrounds and Helmets Don't Mix", Apr. 20, 2009.

* cited by examiner

*Primary Examiner* — Shaun R Hurley
*Assistant Examiner* — Cameron A Carter
(74) *Attorney, Agent, or Firm* — Lambert & Associates; Gary E. Lambert; David J. Connaughton, Jr.

(57) ABSTRACT

A self-closing helmet strap is contemplated to automatically strap a helmet to a user's head. The self-closing strap may be in the form of a curved strap configuration with the straps configured to curve under the user's chin. The self-closing strap may be a spring strap configuration with a strap designed to self-close with the aid of a spring.

16 Claims, 8 Drawing Sheets

SELF-CLOSING HELMET STRAP

BACKGROUND OF THE INVENTION

1. Field of the Invention

The present invention relates generally to head safety systems. More particularly, the present invention relates to a helmet with a self-closing strap.

2. Description of Related Art

Helmets are valuable tools in protecting people engaged in activities where head trauma is a concern. These helmets must be securely held in place so that they remain on the head in the event of an accident. Presently, helmets are secured on the head using nylon straps that clip together under a user's chin.

These nylon straps, while inexpensive to create and familiar to users, are often not strapped together, leaving the helmet unsecured on the head and fully ineffective in the event of an accident. Further, the helmet straps often slip and become loose. Further still, due to the extremely high tensile strength of the nylon straps, strangulation is a major risk in the event that a helmet gets caught on something.

Therefore, what is needed is a self-closing helmet strap that will ensure that the helmet is securely held in place upon the user's head, will maintain its adjustment position without slipping, and will not cause a danger of strangulation.

SUMMARY OF THE INVENTION

The subject matter of this application may involve, in some cases, interrelated products, alternative solutions to a particular problem, and/or a plurality of different uses of a single system or article.

In one aspect, a self closing helmet strap is provided. This device comprises a helmet, left and right front straps connected to the helmet at one end. The straps are pre-formed to wrap under a chin of a user and mate with each other at the other end. When the ends of the left and right front straps are mated they form a securement.

In another aspect, a self closing helmet strap is provided. This device comprises a helmet, a constant force device connected to the helmet, and a front strap having a first and second end. The front strap is connected to the strap end of the constant force device at its first end, and connected to the helmet at its second end.

In yet another aspect, a self closing helmet strap is provided. This device comprises a helmet having a channel running widthwise along its width, a front strap disposed within the channel, a left and right extending side of the front strap extending from the left and right sides of the helmet, respectively, and wherein the left extending side is constructed and arranged to mate with the right extending side to form a securement, and wherein the left extending side and the right extending side are pre-formed to wrap under a chin of a user.

DETAILED DESCRIPTION

Figure 1:
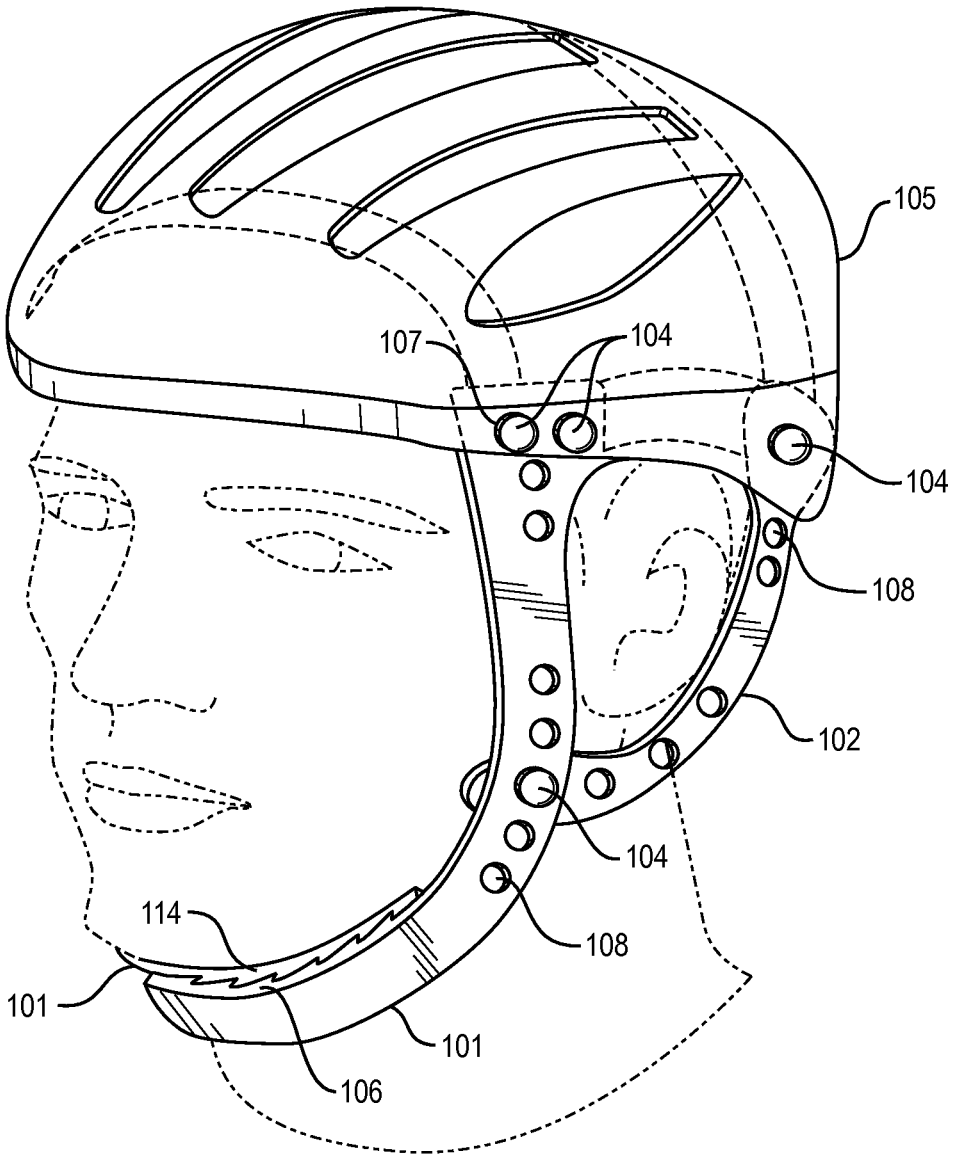
FIG. 1 provides a perspective view of one embodiment of the self closing helmet strap.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a helmet strap device that is capable of automatically self-closing. This self-closing may be achieved in a number of ways, including but not limited to utilizing memory material to return the straps to a closed position; utilizing a constant force spring to bring a strap from an open to closed position, or utilizing a torsion spring to bring the straps from an open to closed position. The present invention further may meet all applicable safety standards set forth in 16 C.F.R. 1203.

The helmet strap device of the present invention may apply to any type of helmet for any use. For example, the present invention may apply to straps on helmets for bicycles, skateboard, inline skating, skiing/snowboarding, motorcycling, car racing, football, hockey, lacrosse, dirt biking, snowmobiles, rock climbing, and skydiving, among others.

In one aspect a helmet strap is configured to self-close automatically by utilizing two straps, one on each side of the helmet. The two straps may be pre-formed to curve under a user's chin. To put on or remove the helmet, the user may deform the straps to an open position. Once on, the user may release the straps, allowing them to return to their pre-formed closed position under the user's chin.

In one embodiment, the straps may be a composite material of a metal surrounded by a plastic. The metal may be any metal with a yield strength high enough to be repeatedly deformed when the strap is moved from a closed to open position. The plastic may be any flexible plastic material that provides comfort, padding, and protection to the user. In one embodiment, the high yield-strength metal is spring steel, and the plastic is a 60 durometer polyurethane with a thickness of 0.008 inches.

The term "high yield-strength" is defined to refer to a yield-strength sufficient to withstand multiple deformations when the strap is moved from a closed to open position. This yield-strength may be a material with yield-strength greater than 50 ksi, and generally may be a material with a yield-strength between 40 and 80 ksi.

In another embodiment, the straps may be formed of a high yield strength plastic.

In still another embodiment the straps may be formed of a high yield strength metal.

In another embodiment, two y-shaped straps are contemplated. This embodiment allows a single construction of the strap with two points connected to a helmet. Preferably, the split of the y portion defines a region large enough to accommodate a user's ear.

In another embodiment, the two straps may connect to the helmet by the strap being molded as one long strip. The strip may be threaded through a channel defined by the helmet allowing the straps to protrude from the helmet. The strap ends may be constructed and arranged to mate with each other under the user's chin. Further, the strap may be split in two and may run through two channels of the helmet.

In a further embodiment, a second strap may be molded as one long strip. This second strap may be threaded through a second channel defined by the helmet and may have ends of the second strap protruding through the helmet. These straps may be constructed and arranged to connect to the first strap.

In yet another embodiment, four straps are contemplated, a left and right front strap, and a left and right rear strap. The left and right front straps are constructed and arranged to connect to a helmet at a first end and to mate to each other under the user's chin at a second end. The left rear strap is constructed to connect to the left front strap at a proximal end and to connect to the helmet behind an ear of the user at a distal end. The right rear strap is constructed to connect to the right front strap at a proximal end and to connect to the helmet behind an ear of the user at a distal end.

The front straps may be constructed to mate with each other at their ends to secure the helmet to the user's head. Preferably the front straps may automatically mate with each other. Any structure that allows a mating of the front straps is sufficient. The mating structure may be in the form of interlocking mating features molded into the material of the straps, or may be attached as a separate element. When the straps are mated in this fashion, they form a securement which acts as a single connection between the helmet and the user's head.

In another embodiment, the front straps may curl under a user's chin without mating. This embodiment may operate by securing the helmet to the user's head by the force exerted between the straps and the user's chin.

In a further embodiment, the mating of the front straps may be achieved by the front straps having a series of ramped ridges. The ramped ridges may be molded into the material of the strap, and are formed such that they can slide over each other to a mating position at portions of the straps constructed to wrap under the user's chin. The ramped ridges may have a shallow slope angle in the direction of closing, and vertical or backwardly sloping faces in the direction of opening. Therefore, the ridges may easily slide closed, but when the ridges of the first and second front straps are in a mated position, they oppose opening forces until the straps are intentionally separated.

In a further embodiment, the first front strap may have a rib protruding at its center and running along its length. The second front strap may have a groove depression at its center and running along its length, this groove is constructed to mate with the protruding rib of the first front strap. This construction serves to prevent the first and second front straps from sliding laterally and disengaging the straps.

In another embodiment, the first and second front straps may be configured to mate together by the use of magnets.

In yet another embodiment, the first and second front straps may be configured to mate together by the use of a protrusion with a flanged head molded into the first front strap and an aperture formed by the second front strap. The flanged head of the protrusion of the first front strap may be formed to be flexible enough to fit through the aperture in a securing direction, but rigid enough to not be unintentionally disengaged from the aperture in an unsecuring direction.

In still another embodiment, the first and second front straps may be configured to mate together by the use of Velcro®.

The helmet straps may be connected to the helmet in any way that provides secure attachment. For example, in one embodiment, the straps may be integrally molded with the helmet material, forming a one piece helmet and strap construction. In another embodiment, the straps may be connected by a hinge device which may further include a torsion spring. In another embodiment this connection may be by way of molded pins. The molded pins being constructed to pass between an aperture of the helmet and an aperture of a strap. Alternatively, the molded pins could extend from and be integral with a surface of either the helmet or the strap, and could pass through an aperture in the strap or helmet, respectively.

In one embodiment, the pins may be constructed of a flexible plastic. The pins may further comprise a large flanged head. The flanged head is designed to fit through mating apertures in the helmet and strap, an aperture in the helmet or an aperture in the strap. The pin head may be positioned on one or both end portions of the pin. The pins thus formed can be securely attached by temporarily deforming the flanged heads to pass the pin head and the pin through an aperture. Once the flanged head passes through the aperture or apertures it returns to its open position and prevents unintentional removal of the pin. Such a structure ensures that once an adjustment position of the straps is chosen, it will remain in that adjusted position until intentionally changed.

Preferably, the straps may be adjustable in length. In one embodiment, the straps may have a plurality of apertures formed along their lengths. These apertures may all be sized to mate with the pin used to connect the straps to the helmet. This configuration allows the straps to be adjusted to receive a wide variety of user head sizes.

In another embodiment, the helmet may have a plurality of apertures formed along its surface, sized to mate with the pin used to connect the straps to the helmet. In this embodiment the strap may be positioned to mate with varying apertures along the helmet via the pin, thereby allowing the straps to be adjusted to receive a wide variety of user head sizes.

The embodiments noted above may further comprise a traditional nylon web portion, disposed between a connection pin region and a pre-formed strap region. The nylon strap may be connected to the aforementioned regions by, for example, a heat welding process.

In another embodiment, the straps may be formed from multiple portions, such as a chin portion, a central portion and a helmet portion. Each of these portions may be joined together. In one embodiment the joining may be achieved by a pin fitting through apertures in the portions. In this embodiment, the portions may have a plurality of apertures sized to receive the pin, the pin may join two portions by passing through an aperture in each portion. This embodiment allows the portions to be joined together at various points, allowing for length adjustment of the straps.

The self-closing helmet strap may further comprise a release mechanism. The release mechanism is a structural feature constructed and arranged to allow a release of the straps at a designated tensile force between the helmet and the straps. In one embodiment, the release mechanism may release the securement. In another embodiment, the release mechanism may release the straps from the helmet. In yet another embodiment, the release mechanism may be positioned on one or both of the straps, to allow one or both of the straps to break away.

Preferably the release mechanism is positioned somewhere along the securement formed by the mating of the left and right front straps. For example, the release mechanism may be located on the left front strap, the right front strap, at the connection point of either or both straps on the helmet, at the mating location of the second ends of the left and right front straps, or on a pin that may be used to connect different portions of the strap together. The designated tensile force required to trigger the release mechanism may vary depending on the size and weight of the user. In one embodiment, the release mechanism may be configured to release at a tensile force on the straps of 160 Newtons.

In one embodiment, this release mechanism may be incorporated into the pins used to join together the strap portions, the pins used to connect the helmet and the straps, or both. The release mechanism may involve a narrowed section near the center of the length of the pin corresponding to a given shearing force. Therefore, when a particular tensile force is applied to the strap, the pin, which is perpendicular to the strap, will break away, releasing the straps from the helmet.

In another embodiment there may be four pins joining together various parts of a first and second front strap and a first and second rear strap, each pin may be constructed and arranged to release at a shearing force of 40 Newtons.

In yet another embodiment, the release mechanism may be configured by structuring the flanged head of the pin to pull through its mating hole at a given force.

In still another embodiment the release mechanism can be designed into the straps. For example, a narrowed portion of the strap could be constructed and arranged to release upon a given tensile force.

It should be noted that the release mechanism also may be incorporated into a traditional helmet strap. For example, one embodiment involves a traditional latching device designed to give way at a designated tensile force. The device could comprise a narrowed section of material that would release at a given force. In another embodiment the device could be a different material than the traditional helmet strap that is designed to release at a given tensile force.

In another aspect a helmet strap is configured to self-close automatically by attaching a constant force device between a helmet and a strap. The constant force device capable of applying a constant force to the helmet strap.

In one embodiment, the constant force device is a constant force spring enclosed within a housing. In this embodiment, the strap utilizes a partially unwound section of constant force spring to aid in holding the straps in a closed position. A rolled portion of the constant force spring is attached to the helmet by a rod, about which the spring may roll or unroll as required. Thus the strap is automatically moved from an open to closed position by the force of the constant force spring which automatically rolls around the rod to return the spring and the strap to its original closed position. The force required to unroll the constant force spring may be any force that allows a child to extend the spring, but that also has enough force to retract the spring against the weight of the strap. In one embodiment, the constant force spring may have a maximum travel of 30 mm.

In another embodiment, two constant force springs are employed. One constant force spring on a first connection between the strap and the helmet, and another constant force spring on a second connection between the strap and the helmet.

In another embodiment, the helmet strap may have one constant force spring attached to the helmet at its two ends. A first spring end that may roll and unroll around a rod attached to the helmet. A second spring end is directly connected to the helmet. A center portion of the spring may be passed through an elastomer material and is positioned under the user's chin for enhanced comfort and safety. To put on or remove the helmet, the user may grasp the strap and pull it away from their chin. The strap thus configured automatically returns to a closed position by the constant tightening force on the strap caused by the constant force spring.

In a further embodiment, the present aspect may further include a left rear strap and a right rear strap. The left rear strap may be designed to connect to the front strap at a proximal end, and to connect to the helmet at a distal end. The right rear strap may be designed to connect to the front strap at a proximal end, and to connect to the helmet at a distal end.

The strap thus configured may be adjustable by way of the flexibility of the constant force spring. In one embodiment, further adjustability may be achieved by way of a spacer or spacers. The spacer or spacers may be removably clipped or otherwise attached to the sides of the constant force spring. The spacer or spacers serve to adjust the strap to the individual user's chin, thereby preventing a constant pull on the user's chin during use. In another embodiment, the spacer or spacers may be removably clipped or otherwise attached to the strap.

In another embodiment, the strap may be attached to a female buckle member. The female buckle member may be constructed and arranged to mate with a male buckle member to secure the strap to the helmet. The constant force device is positioned to apply force between the helmet and the female buckle member, thus pulling the female buckle member into a mating position with the male buckle member. Therefore, the helmet strap is automatically closed by the force of the constant force device bringing the male buckle member and the female buckle member into a mating position. To remove the helmet, a user must release the female buckle member, separate it from the male buckle member, and pull the female buckle member away from the male buckle member against the force of the constant force device. It should be understood that buckle configuration may be reversed without straying from the scope of the invention.

The strap of this aspect may further have a release mechanism constructed and arranged to release from the helmet at a designated force. For example, this force may be 160 Newtons. One embodiment of the release mechanism may be the constant force spring itself, with the spring being designed to unroll at a given tensile force on the helmet strap. Another embodiment of the release mechanism may be a shearing pin that attaches the strap to the helmet. This pin may be designed to release at a designated shear force. In still another embodiment, the release mechanism may be a narrowed region along the strap that is constructed and arranged to break away at a particular tensile force. In yet another embodiment, the rod may be constructed to break away and release the strap at a designated shearing force.

At least one of the helmet strap or straps may further have an annoyance element. The annoyance element is configured to cause annoyance when the helmet strap is in an unsecured position, and not cause annoyance when the helmet strap is in a secured position.

In one embodiment, the annoyance element may be constructed as a flexible protrusion on a portion of one of the straps located under the user's chin. Preferably this embodiment is molded to a strap to prevent it from being detached or broken. This protrusion may stick up and cause discomfort to the user's chin or neck until it is flexed downwardly and secured to a receiver on the other strap. The receiver may be in the form of a buckle, button, snap, or Velcro®, among other examples.

In another embodiment, a strap may be pre-formed to both curl under a user's chin and to further curl upwardly such that it causes discomfort to the user until mated with an opposing strap under the user's chin.

In yet another embodiment, the ramped ridges of the front straps may have the additional effect of being an annoyance element when not mated together. This embodiment involves ramped ridges that are particularly sharp, and formed of rigid material.

In still another embodiment, the annoyance element may be an electronic device such as a beeper or buzzer. For example, an electronic beeper could beep in an annoying fashion until the straps were secured.

Turning now to FIG. 1 one embodiment of the self closing helmet strap is shown. A helmet 105 is secured upon a user's head by a front strap 101 and a rear strap 102. The front strap 101 and rear strap 102 pass through channels formed by the body of the helmet 105 with portions extending out of each side of the helmet 105. The front strap 101 is secured to the user's head by the mating of an upper set of ramped ridges 114 of the front strap 101 and a lower set of ramped ridges 106 on the front strap 101. Each set of ramped ridges 106, 114 is constructed and arranged to mate with the other set, as shown. The front strap 101 is constructed in a pre-formed shape to conform under the user's chin. Preferably, the front strap 101 is constructed of a material with a high yield strength such as spring steel surrounded by a plastic.

The front strap 101 and rear strap 102 include a plurality of adjustment apertures 108 which allow for connection and adjustment of the front strap 101 and rear strap 102. The front strap 101 and rear strap 102 are connected by a pin 104 which is constructed and arranged to pass through an adjustment aperture 108 in the front strap 101 when aligned with an adjustment aperture 108 in the rear strap 102. The pin 104 has flanged heads. These flanged heads extend from the body of the pin and are capable of deformation when pushed through the adjustment apertures 108.

The helmet 105 further includes helmet apertures 107 that are sized to receive a pin 104. The helmet apertures are designed to align with an adjustment aperture 108 of the front strap 101 or rear strap 102, at which point a pin 104 may be inserted through a helmet aperture 107 and an adjustment aperture 108 in order to secure the front strap 101 to the helmet 105 and the rear strap 102 to the helmet 105.

Figure 2:
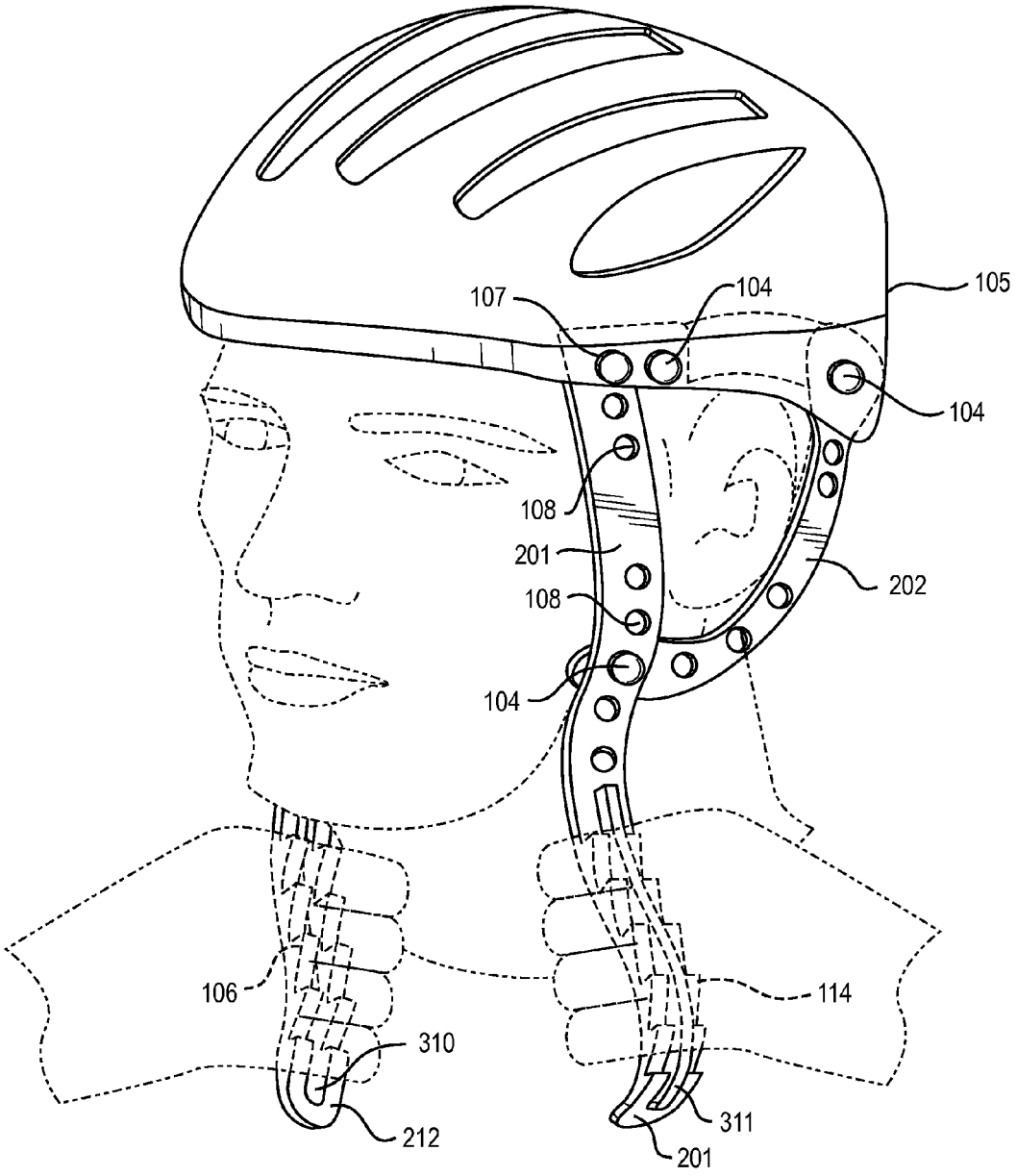
FIG. 2 provides a perspective view of one embodiment of the self closing helmet strap.

FIG. 2 shows another embodiment of the self closing helmet strap. In this embodiment, four straps are contemplated. A left front strap 201, a right front strap 212, a left rear strap 202, and a right rear strap (not shown). The left front strap 201 and right front strap 212 are shown in an opened position. The straps are connected to the helmet 105 by pins 104 running through a helmet aperture 107 of the helmet 105 and an adjustment aperture 108 of a strap.

The left front strap 201 and the left rear strap 202 connect to one another by the alignment of adjustment apertures 108 of each strap. Once aligned a pin 104 runs through the adjustment apertures 108 and thereby connects the left front strap 201 and left rear strap 202.

The left front strap 201 and right front strap 212 of the illustrated embodiment are shown in an opened position. The left front strap 201 has a plurality of upper ramped ridges 114, as well as a lengthwise ridge 311. The right front strap 212 has a plurality of lower ramped ridges 106, as well as a lengthwise groove 310.

Figure 3:
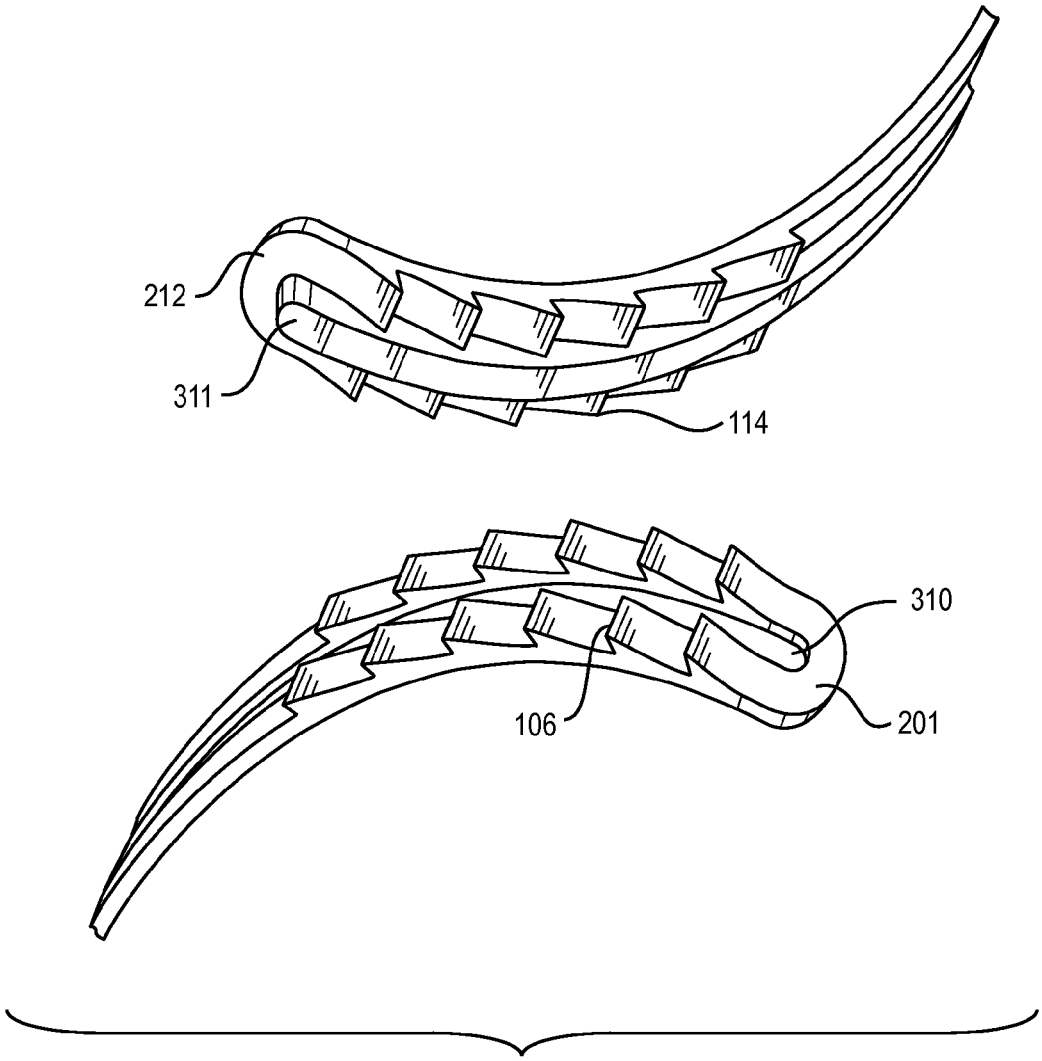
FIG. 3 provides a detail view of one embodiment of a self-closing portion of the self closing helmet strap.

FIG. 3 shows a detail view of one embodiment of the left front strap 201 and right front strap 212 of the present invention. The lower ramped ridges 106 and the upper ramped ridges 114 have a shallow slope angle in the direction of closing and mating of the straps. Further, the lower ramped ridges 106 and upper ramped ridges 114 have backwardly sloping faces in the direction of opening which oppose opening forces until the straps are intentionally separated.

Further, the right front strap 212 has a lengthwise ridge 311 which extends as a protrusion past the ramped ridges 114 along the length of the right front strap 212. The left front strap 201 has a lengthwise groove 310 depressed below the ramped ridges 106 along the length of the left front strap 201. The lengthwise ridge 311 is constructed and arranged to mate with the lengthwise groove 310 to prevent lateral separation of the straps when in a mated position. Preferably the edges of the lengthwise ridge 311 are curved to facilitate its mating with the lengthwise groove 310.

Figure 4:
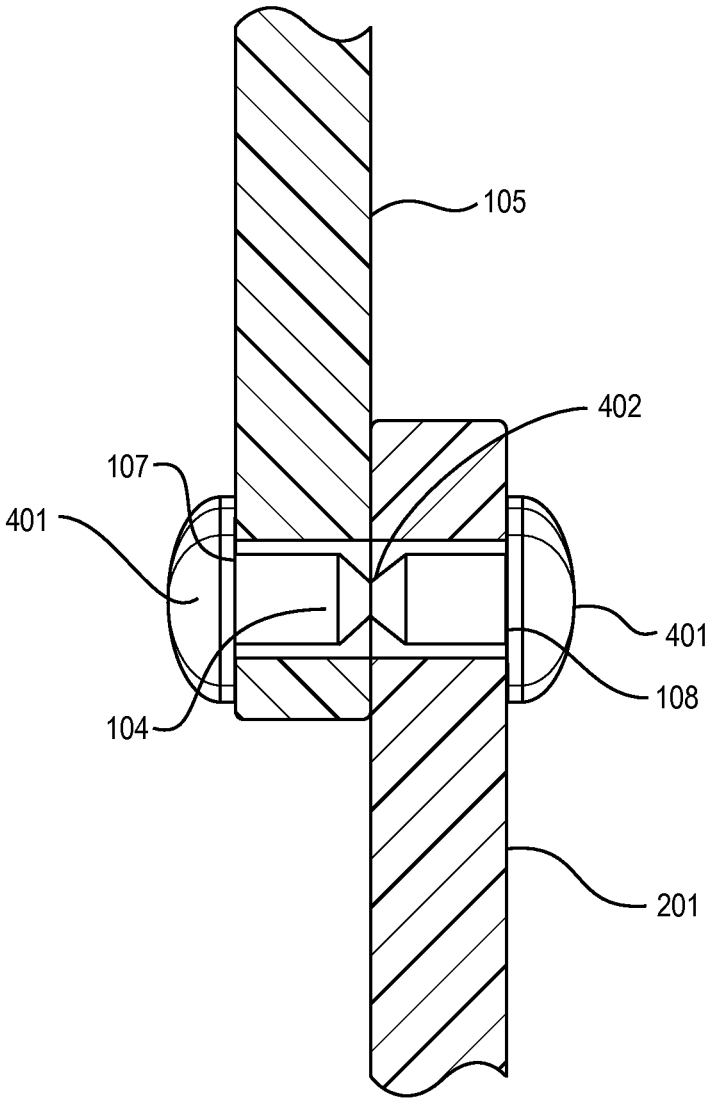
FIG. 4 provides a detail view of one embodiment of a connection of a self closing helmet strap to a helmet.

FIG. 4 is a detail view of a connection between the helmet 105 and the left front strap 201. The pin 104 can be seen to be positioned within the helmet aperture 107 and the adjustment aperture 108, thereby securing the two elements together. The pin 104 is provided with flanged heads 401. These flanged heads extend beyond the helmet aperture 107 and adjustment aperture 108. Further, the pin 104 has a narrowed region 402.

Figure 5:
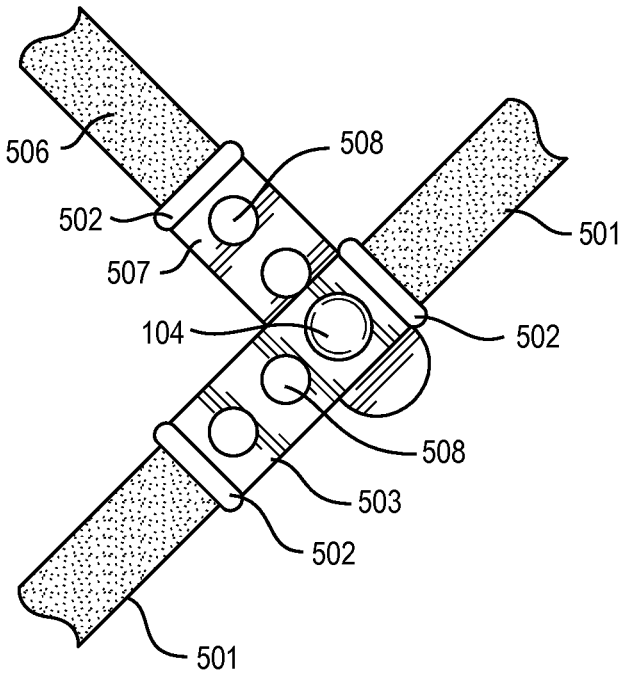
FIG. 5 provides a view of one embodiment of a connection between a first strap and a second strap.

FIG. 5 shows a detail view of an embodiment of a connection between a first strap 501 and a second strap 506. The first strap 501 can be seen constructed of nylon webbing. This nylon webbing is fused to a first strap adjustment device 503 at a fusion point 502. The adjustment device 503 is a portion of the strap that has a plurality of apertures 508 configured to receive a pin 104. Further, the second strap 506, made of nylon webbing, is similarly fused to a second strap adjustment region 507 by a fused region 502. The second strap adjustment region has a plurality of apertures 508 configured to mate with a pin 104. When an aperture 508 of the second strap 506 and an aperture 508 of the first strap 501 are aligned, a pin 104 may be disposed between the apertures.

Figure 6:
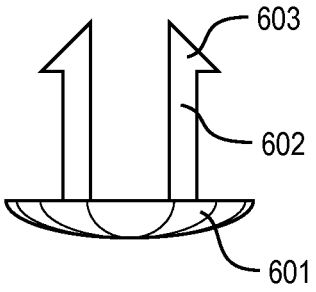
FIG. 6 provides an illustration of one embodiment of a pin of the present invention.

FIG. 6 shows an embodiment of a pin of the present invention. The pin has a flanged head 601 that serves as a base for the pin. Extending from a lower surface of the flanged head 601 are two arms 602. These arms end with outwardly fanged protrusions 603, having angled outer faces. The angled outer faces allow for the pin to be inserted into an aperture by the arms 602 flexing under the inward force caused by pressing the pin into an aperture with a diameter less than the distance between the outer portion of each outwardly flanged protrusion 603. Once the pin is inserted into an aperture, the arms 602 relax and the outwardly flanged protrusions 603 prevent the pin from being unintentionally removed.

Figure 7:
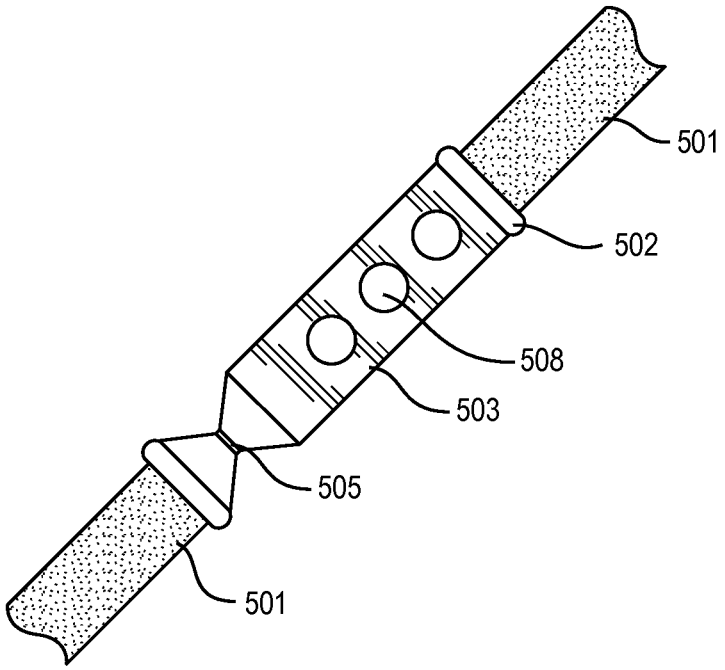
FIG. 7 provides an illustration of an embodiment of a release mechanism of the self closing helmet strap.

FIG. 7 shows an embodiment of a release mechanism of the present invention. The first strap 501 is fused to an attachment device 503 by a fused region 502. The attachment device 503 has a plurality of apertures 508. The attachment device 503 further has a narrowed region 505 which is constructed to be narrow enough to break away at a designated tensile force.

Figure 8:
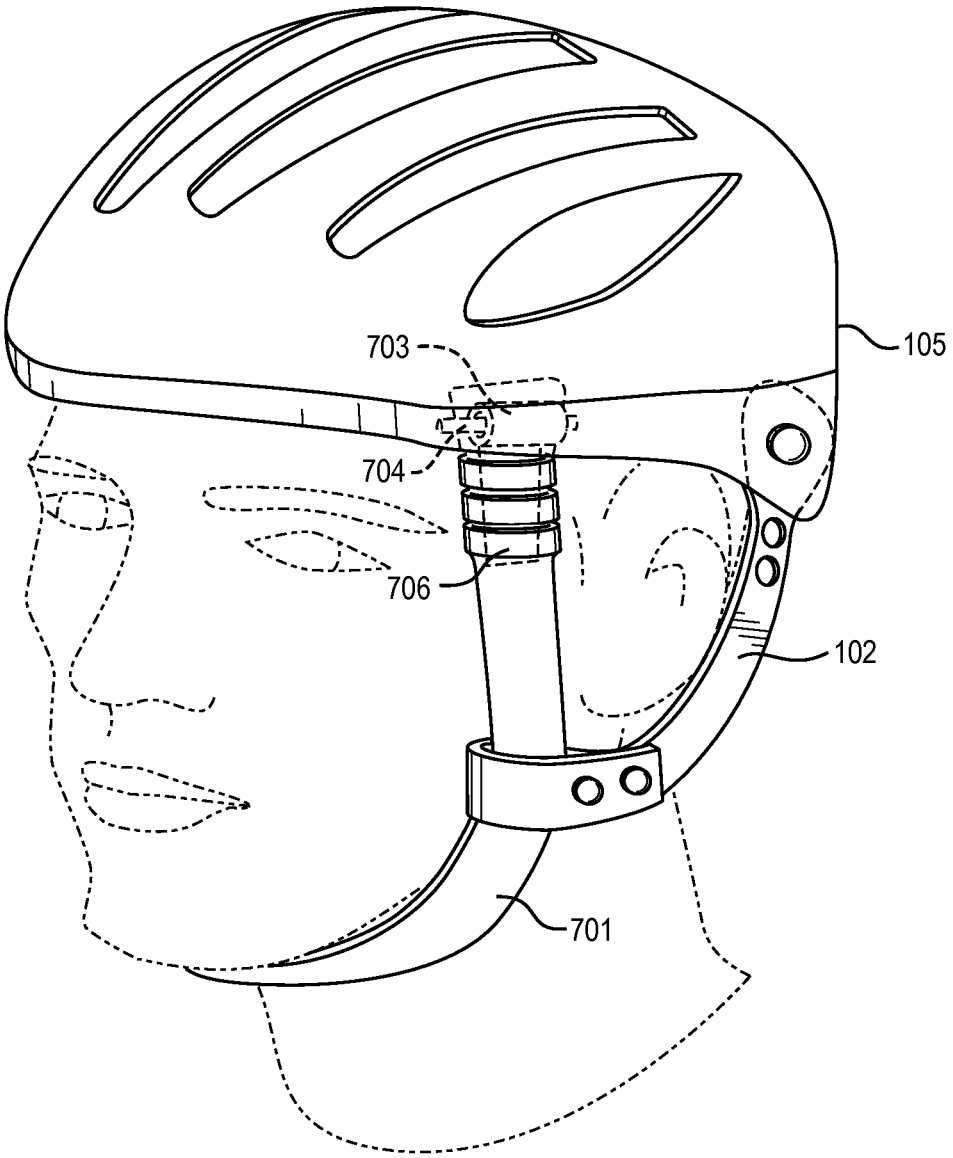
FIG. 8 provides a perspective view of one embodiment of the self closing helmet strap.

FIG. 8 shows another embodiment of the self closing helmet strap. A helmet 105 can be seen secured on a user's head. The front strap 701 runs under the chin of the user. The rear strap 102 attaches to the front strap 701 at a first end and attaches to the helmet behind the ear of the user at a second end. In this embodiment, the front strap 701 includes a constant force spring 703 attached to the strap 701 at a first end and rolled around a rod 704 located within the helmet 105 at a second end. The strap further includes spacers 706 which are removably clipped to the front strap 701.

Figure 9:
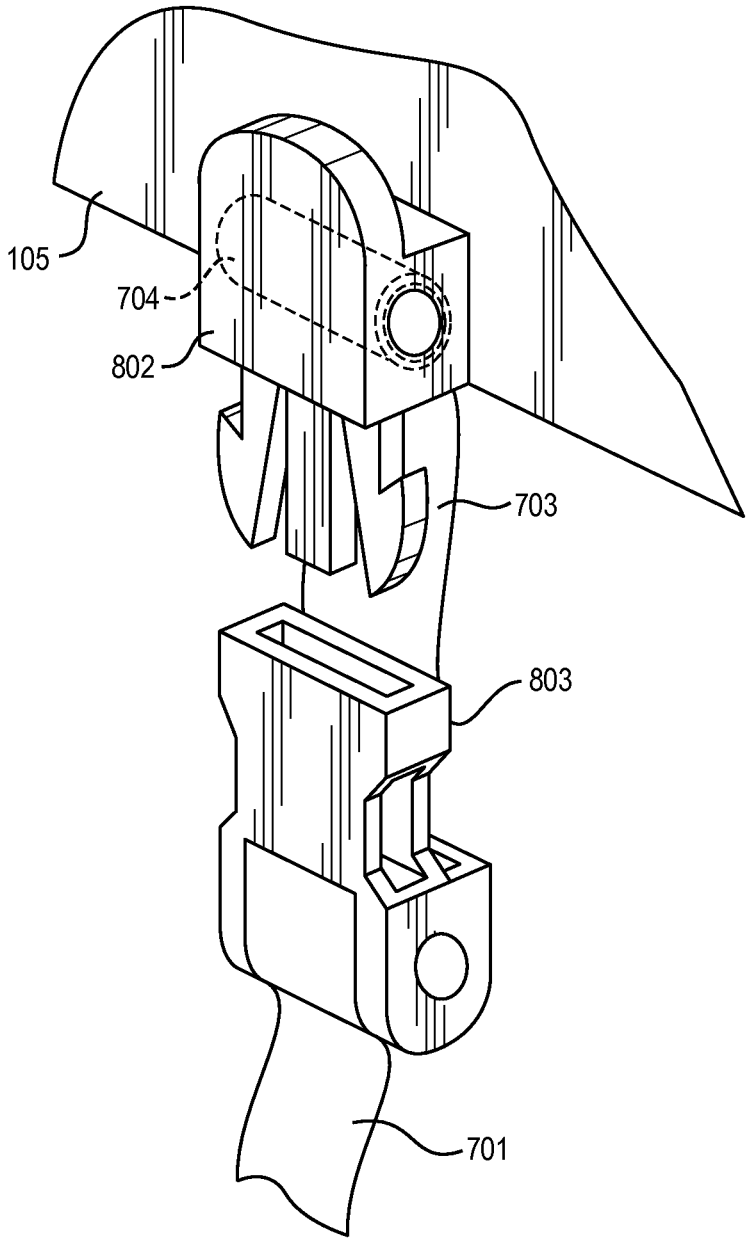
FIG. 9 provides a detail view of an embodiment of the connection between the strap and the helmet.

FIG. 9 shows a detail view of another embodiment of the connection between the strap and the helmet. A male buckle member 802 is attached to the helmet 105. Within the helmet 105 in line with the male buckle member 802 is a rod 704. The rod 704 is constructed to have a constant force spring 703 wrapped about it. The constant force spring 701 is connected to the female buckle member 803, and the female buckle member 803 is attached to the strap 701. The female buckle member 803 is constructed and arranged to mate with the male buckle member 802. Therefore, a constant closing force is applied to the female buckle member 803, urging it to a closed and secured position by the constant force spring 703.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A self-closing helmet strap comprising:

A helmet;

A left front strap having a first end connected to the helmet;

Wherein a second end of the left front strap is constructed and arranged to automatically mate with a second end of the right front strap to form a securement when in a closed, mated position; and Wherein the second end of the left front strap and the second end of the right front strap having a resilient curvature of shape to fixedly wrap under a chin of a helmet user, the shape of the second end of the left front strap and the second end of the right front strap causing them to automatically mate together in the closed position, the second end of the right front strap being capable of an open position when manually drawn away from each other, the second of the left front strap and the second end of the right front strap moving back to the closed position when released from the open position.

2. The self closing helmet strap of claim 1 further comprising:

a left rear strap and a right rear strap;

the left rear strap connected to the helmet at a distal end and connected to the left front strap at a proximal end;

the right rear strap connected to the helmet at a distal end and connected to the right front strap at a proximal end.

3. The self closing helmet strap of claim 1 wherein the left front strap is constructed of a material having a high yield-strength, and wherein the right front strap is constructed of the material having a high yield-strength.

4. The self closing helmet strap of claim 1 wherein the first end of the left front strap is connected to the helmet by a left torsion spring, and wherein the first end of the right front strap is connected to the helmet by a right torsion spring.

5. The self closing helmet strap of claim 2 wherein the left front strap forms a plurality of apertures along its length, and wherein the right front strap forms a plurality of apertures along its length.

6. The self closing helmet strap of claim 5 wherein the left rear strap forms a plurality of apertures along its length, and wherein the right rear strap forms a plurality of apertures along its length.

7. The self closing helmet strap of claim 5 wherein a pin is disposed through one of the plurality of apertures of the left front strap and an aperture formed by the helmet.

8. The self closing helmet strap of claim 6 wherein a pin is disposed through one of the plurality of apertures of the left front strap and one of the plurality of apertures of the left rear strap.

9. The self closing helmet strap of claim 7 wherein the pin is constructed and arranged to release at a designated shearing force applied to the pin.

10. The self closing helmet strap of claim 1 further comprising a release mechanism positioned along the securement formed by the left front strap and the right front strap when in the closed position, the release mechanism constructed and arranged to release the straps at a designated tensile force on the securement.

11. The self closing helmet strap of claim 1 wherein the second end of the left front strap is constructed and arranged to mate with the second end of the right front strap by a mating feature molded into the left front strap constructed and arranged to interlock with a mating feature molded into the right front strap.

12. The self closing helmet strap of claim 1 wherein the second end of the left front strap is constructed and arranged to mate with the second end of the right front strap by a plurality of ramped ridges on the left front strap capable of interlocking with a plurality of ramped ridges on the right front strap.

13. The self closing helmet strap of claim 1 wherein the second end of the left front strap has a ridge extending along its length, and the second end of the right front strap has a groove depressed along its length, the groove being sized to receive the ridge in a mating fashion.

14. The self closing helmet strap of claim 1 further comprising an annoyance element constructed and arranged to cause discomfort to a user when the second end of the left front strap and the second end of the right front strap are not in a mated position.

15. The self closing helmet strap of claim 14 wherein the annoyance element is a protrusion from the second end of the right front strap that extends upward until manually secured around the left front strap when the straps are in a mated position and into a receiver on the left front strap.

16. The self closing helmet strap of claim 14 wherein the annoyance element is a pre-formed curl on the second end of the left front strap that extends upwardly unless mated with the second end of the right front strap.

* * * * *